US005878881A

United States Patent [19]

Hunt

[11] Patent Number: 5,878,881

[45] Date of Patent: Mar. 9, 1999

[54] STORAGE SAVER SYSTEM

[76] Inventor: Ricardo Hunt, 2316 Camden Cir., Valdosta, Ga. 31602

[21] Appl. No.: 867,559

[22] Filed: Jun. 2, 1997

[51] Int. Cl.[6] ..... A01R 39/38; B65D 21/024

[52] U.S. Cl. ..... 206/361; 206/362.2; 206/461; 206/470; 206/504; 220/571.1; 220/571; 15/184

[58] Field of Search ..... 206/363, 408, 206/493, 361, 362.2, 461, 470, 806, 503, 504, 508, 316.2, 570; 220/571, 571.1; 15/184; 190/102

[56] References Cited

U.S. PATENT DOCUMENTS

| | | | |
|---|---|---|---|
| D. 309,358 | 7/1990 | Machelett et al. | 206/303 |
| 3,308,933 | 3/1967 | Beck | 206/303 |
| 3,519,128 | 7/1970 | Swanberg | 206/461 |
| 4,260,004 | 4/1981 | Domke | 206/316.2 |
| 4,386,642 | 6/1983 | Durbin | 206/570 |
| 4,424,841 | 1/1984 | Smith | 190/102 |
| 4,993,767 | 2/1991 | Song | 220/571 |
| 5,007,540 | 4/1991 | Beasley et al. | 206/504 |
| 5,037,000 | 8/1991 | Selame | 206/470 |
| 5,096,030 | 3/1992 | Espinosa et al. | 190/102 |
| 5,115,916 | 5/1992 | Beasley et al. | 206/504 |
| 5,207,303 | 5/1993 | Oswalt et al. | 206/570 |
| 5,337,910 | 8/1994 | Picozza et al. | 220/571 |
| 5,582,321 | 12/1996 | Urbanczyk | 206/756 |

*Primary Examiner*—Paul T. Sewell
*Assistant Examiner*—Anthony Stashick
*Attorney, Agent, or Firm*—Michael I. Kroll

[57] ABSTRACT

A storage saver system (22) comprising a storage container (24) which includes a generally cylindrical shaped base (26) having a compartment (28) to hold at least one article (30) therein. A cover (32) extends over the compartment (28) of the base (26). A hinge (34) attaches the cover (32) to a top edge of the base (26). A structure (36) is for retaining the cover (32) in a closed position over the compartment (28), to keep the at least one article (30) within the compartment (28) of the base (26).

18 Claims, 7 Drawing Sheets

Fig. 4
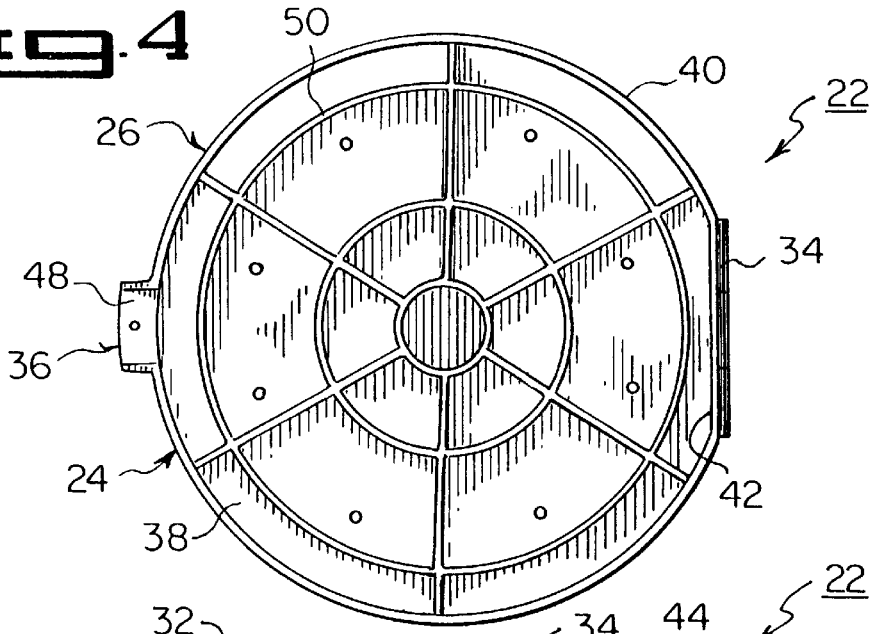
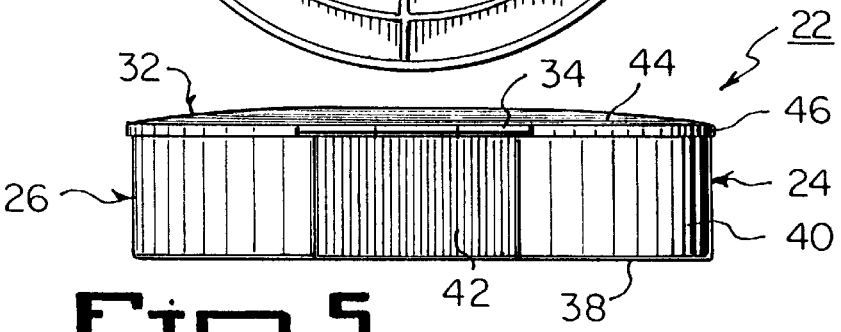
Fig. 5
Fig. 6
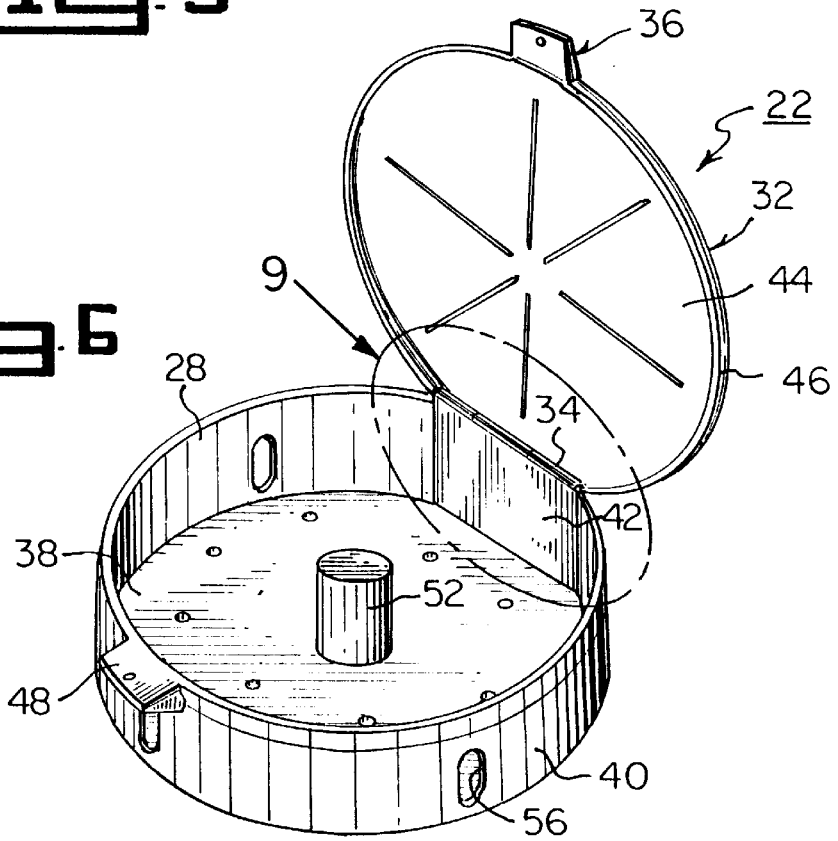

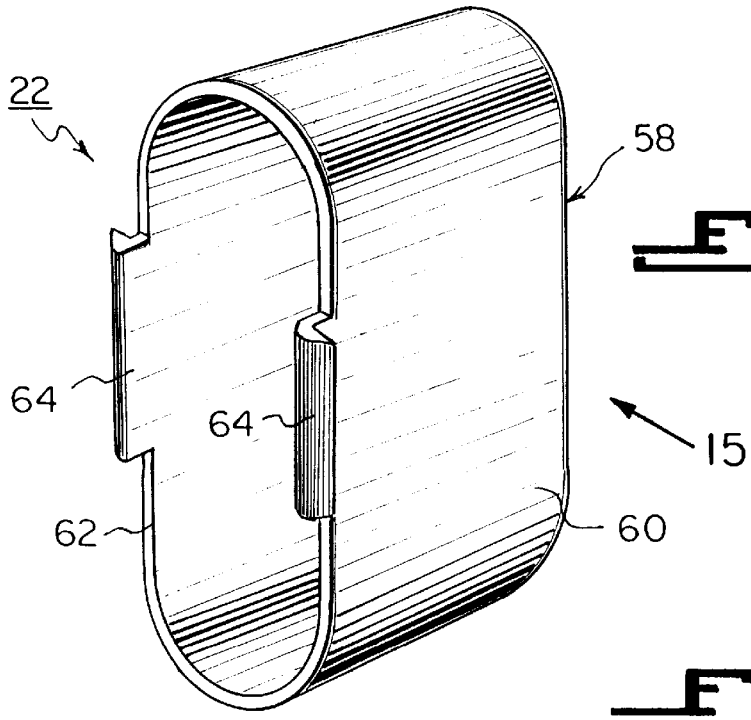
Fig. 14
Fig. 16
Fig. 15
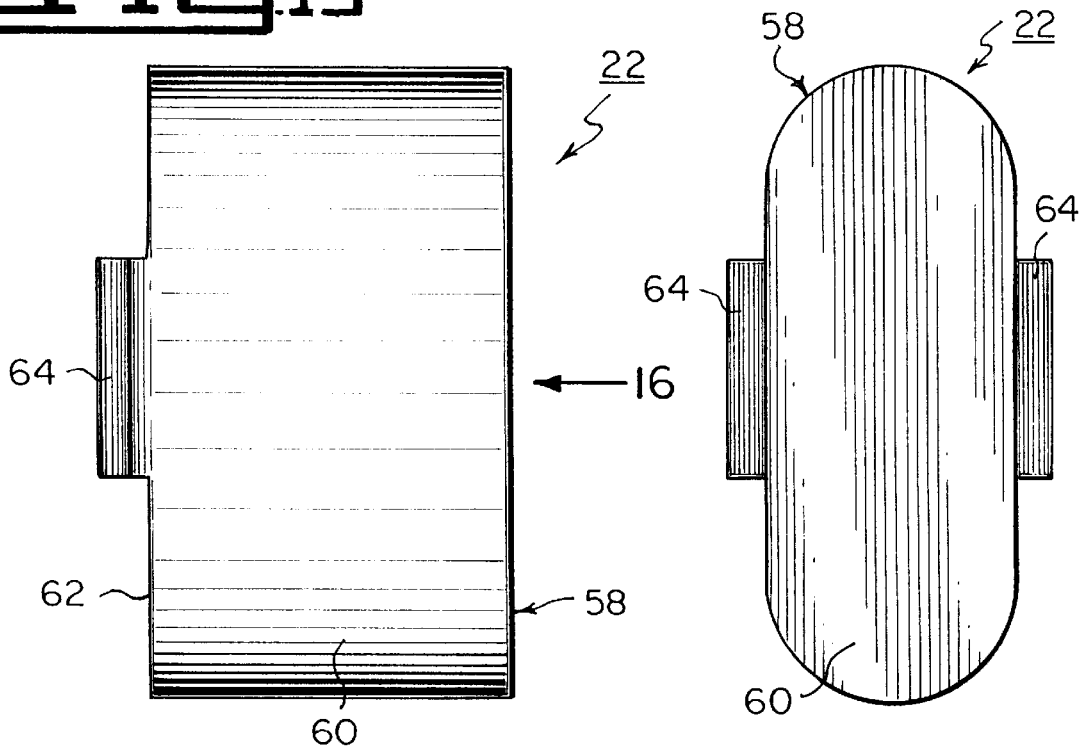

STORAGE SAVER SYSTEM

BACKGROUND OF THE INVENTION

1. Field of the Invention

The instant invention relates generally to storage containers and more specifically it relates to a storage saver system. The storage saver system will hold a brush pad or various types of equipment used in conjunction with a floor buffing machine.

2. Description of the Prior Art

Numerous storage containers have been provided in prior art that are adapted to retain various articles for protection and future use. For example, U.S. Pat. No. Des. 369,905 to Hunt is illustrative of such prior art. While this unit may be suitable for the particular purpose to which it addresses, it would not be as suitable for the purposes of the present invention as heretofore described.

HUNT, RICARDO

STORAGE CONTAINER

U.S. Pat. No. Des. 396,905

The ornamental design for a storage container, as shown and describes.

FIG. 4 is a bottom plan view of a storage container showing the new design;

FIG. 5 is a rear elevational view of a storage container showing the new design; and FIG. 6 is a top perspective view in the open position of a storage container showing the new design.

SUMMARY OF THE INVENTION

Figure 1:
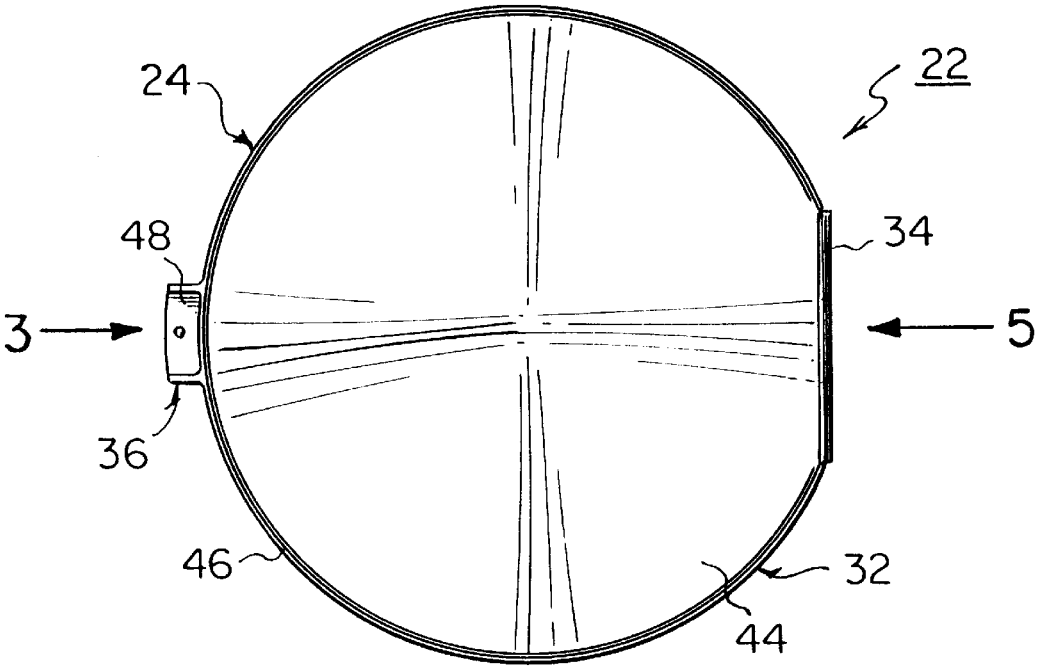
FIG. 1 is a top plan view of a storage container showing the new design.

A primary object of the present invention is to provide a storage saver system that will overcome the shortcomings of the prior art devices.

Another object is to provide a storage saver system that is a storage container to hold a brush pad or various types of articles being utilized in conjunction with a floor buffing/cleaning machine.

An additional object is to provide a storage saver system in which two storage containers can be removably connected in a back-to-back relationship, so that the storage containers can be both carried by a handle attached to one of the storage containers to various locations.

A further object is to provide a storage saver system that is simple and easy to use.

A still further object is to provide a storage saver system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 a top plan view of a storage container of the instant invention, for holding a pad brush of a floor buffing/cleaning machine therein.

Figure 2:
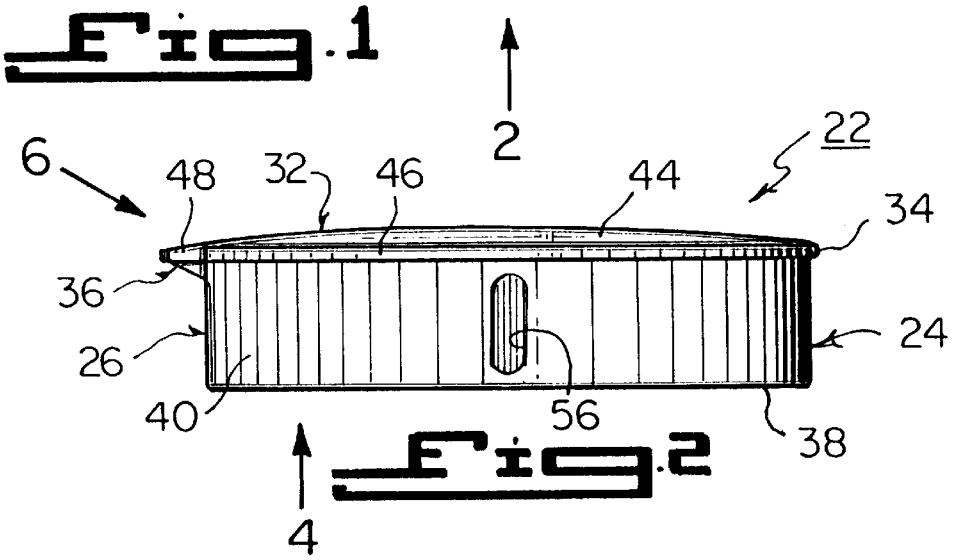
FIG. 2 is left side elevational view thereof, the right side view being a mirror image.

FIG. 2 is a side elevational view taken in the direction of arrow 2 in FIG. 1.

Figure 3:
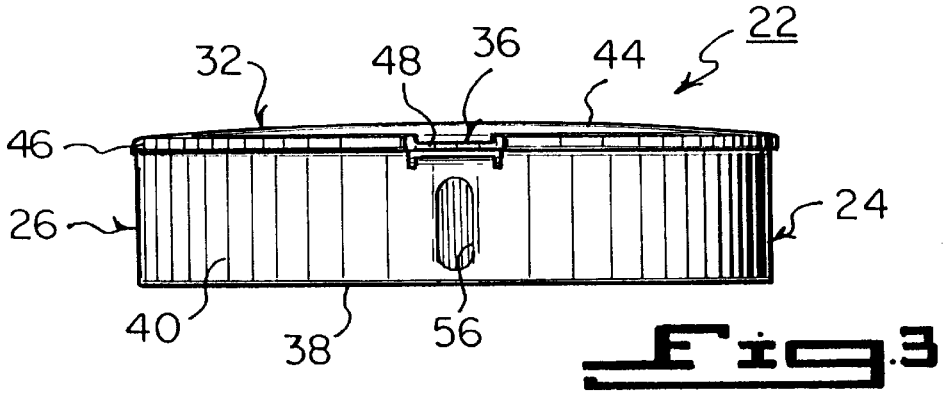
FIG. 3 is a front elevational view of a storage container showing the (new design.

FIG. 3 is a front elevational view taken in the direction of arrow 3 in FIG. 1.

FIG. 4 is a bottom plan view taken in the direction of arrow 4 in FIG. 2.

FIG. 5 is a rear elevational view taken in the direction of arrow 5 in FIG. 1.

FIG. 6 is a perspective view taken in the direction of arrow 6 in FIG. 2, with the cover opened.

Figure 7:
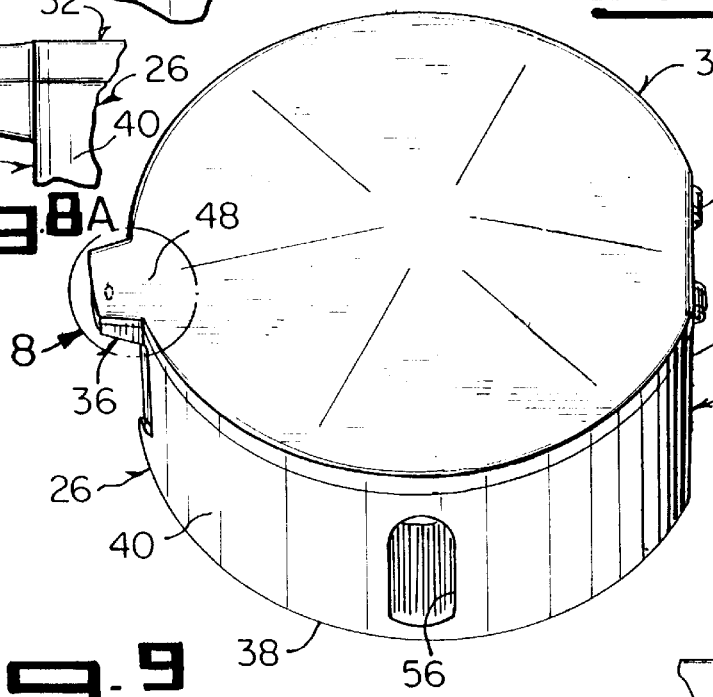

FIG. 7 is a top perspective view similar to FIG. 6, with the cover closed.

Figure 8:
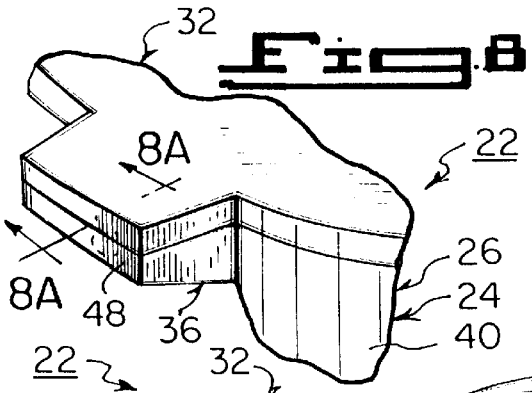

FIG. 8 is an enlarged perspective view of an area of FIG. 7 as indicated by arrow 8, showing the latch mechanism in greater detail.

Figure 8A:
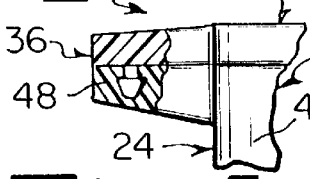

FIG. 8A is a partial cross sectional view taken along line 8A—8A in FIG. 8.

Figure 9:
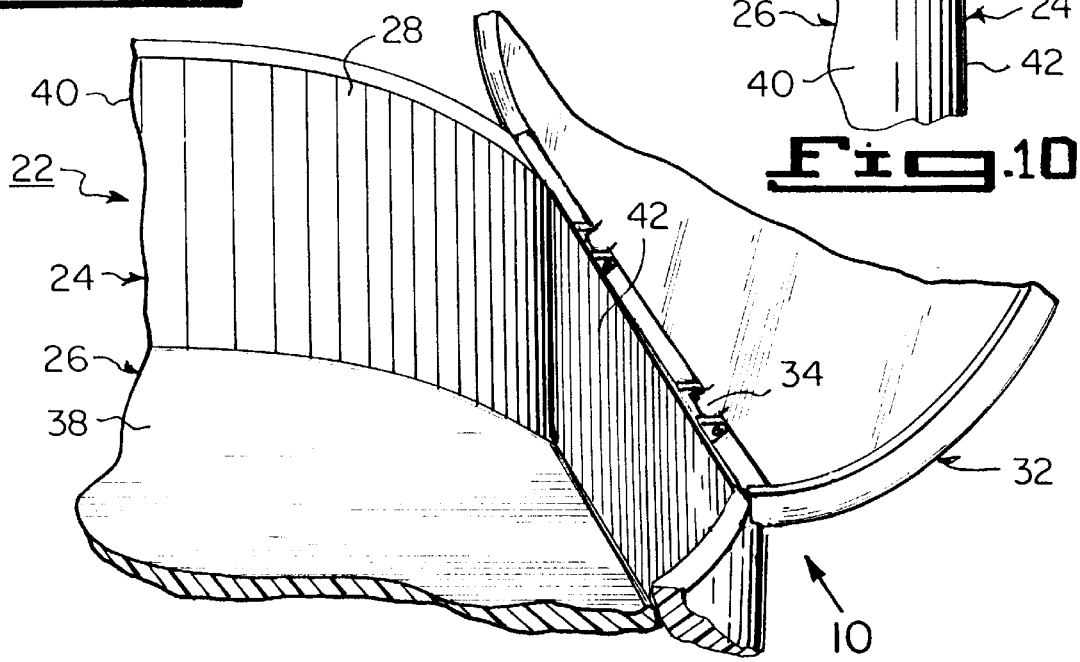

FIG. 9 is an enlarged perspective view of an area of FIG. 6 as indicated by arrow 9, showing the hinge structure in greater detail.

Figure 10:
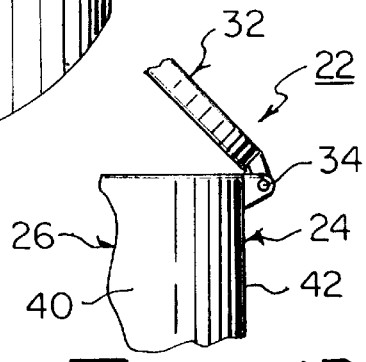

FIG. 10 is a partial side elevational view taken in the direction of arrow 10 in FIG. 9.

Figure 11:
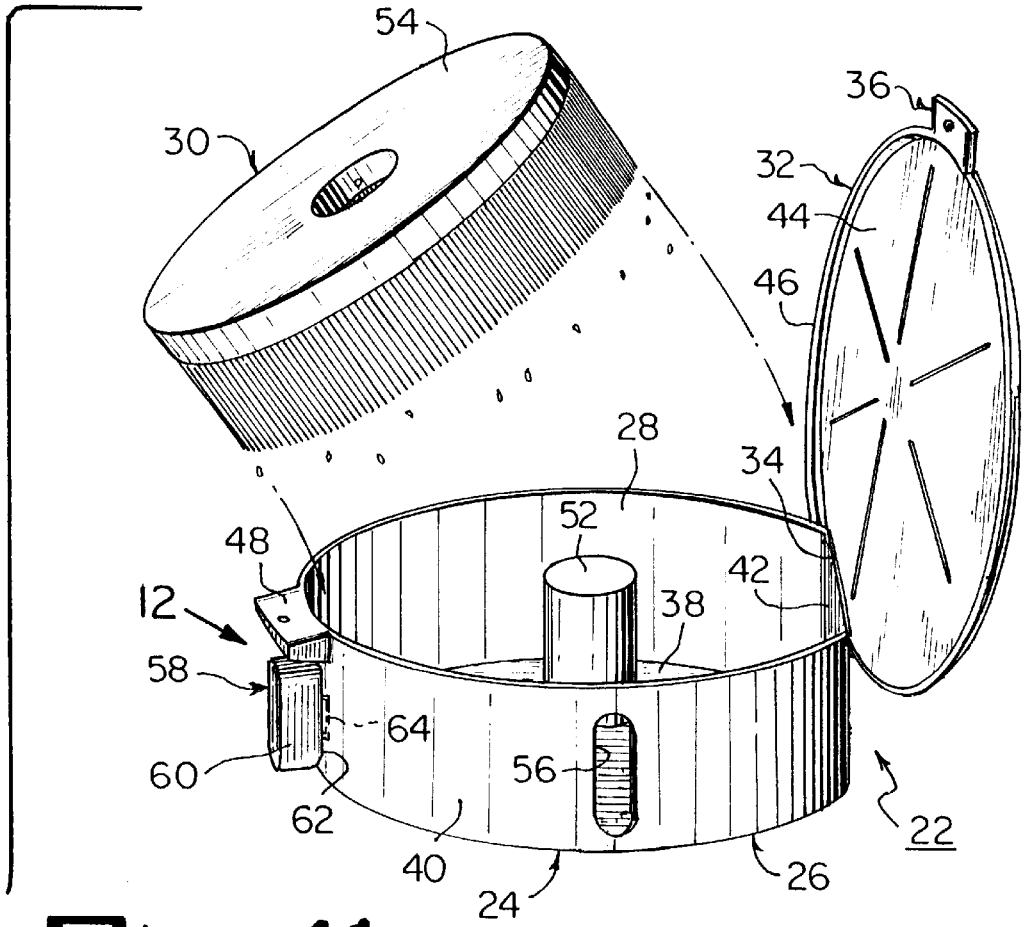

FIG. 11 is a perspective view similar to FIG. 6, showing a drip cup connected to one of the ventilation vents and a wet brush pad ready to be inserted onto the center spindle within the compartment of the base.

Figure 12:
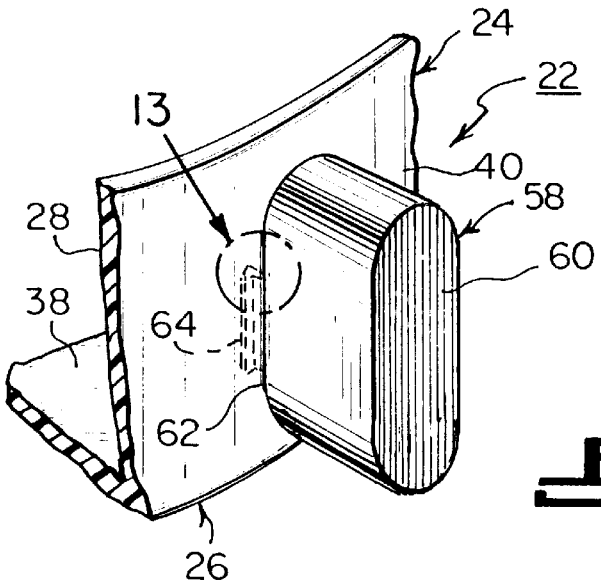

FIG. 12 is an enlarged perspective view taken in the direction of arrow 12 in FIG. 11, with parts broken away and in section.

Figure 13:
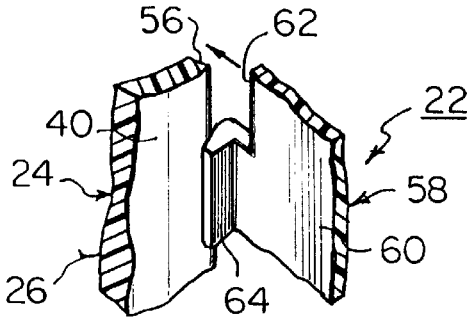

FIG. 13 is a further enlarged perspective view of an area of FIG. 12, showing the tab retainer of the drip cup ready to be inserted into the ventilation vent of the base.

FIG. 14 is a enlarged perspective view of the drip cup per se.

FIG. 15 is a side elevational view taken in the direction of arrow 15 in FIG. 14.

FIG. 16 is a rear elevational view taken in the direction of arrow 16 in FIG. 15.

Figures 17, 18, 19, 20:
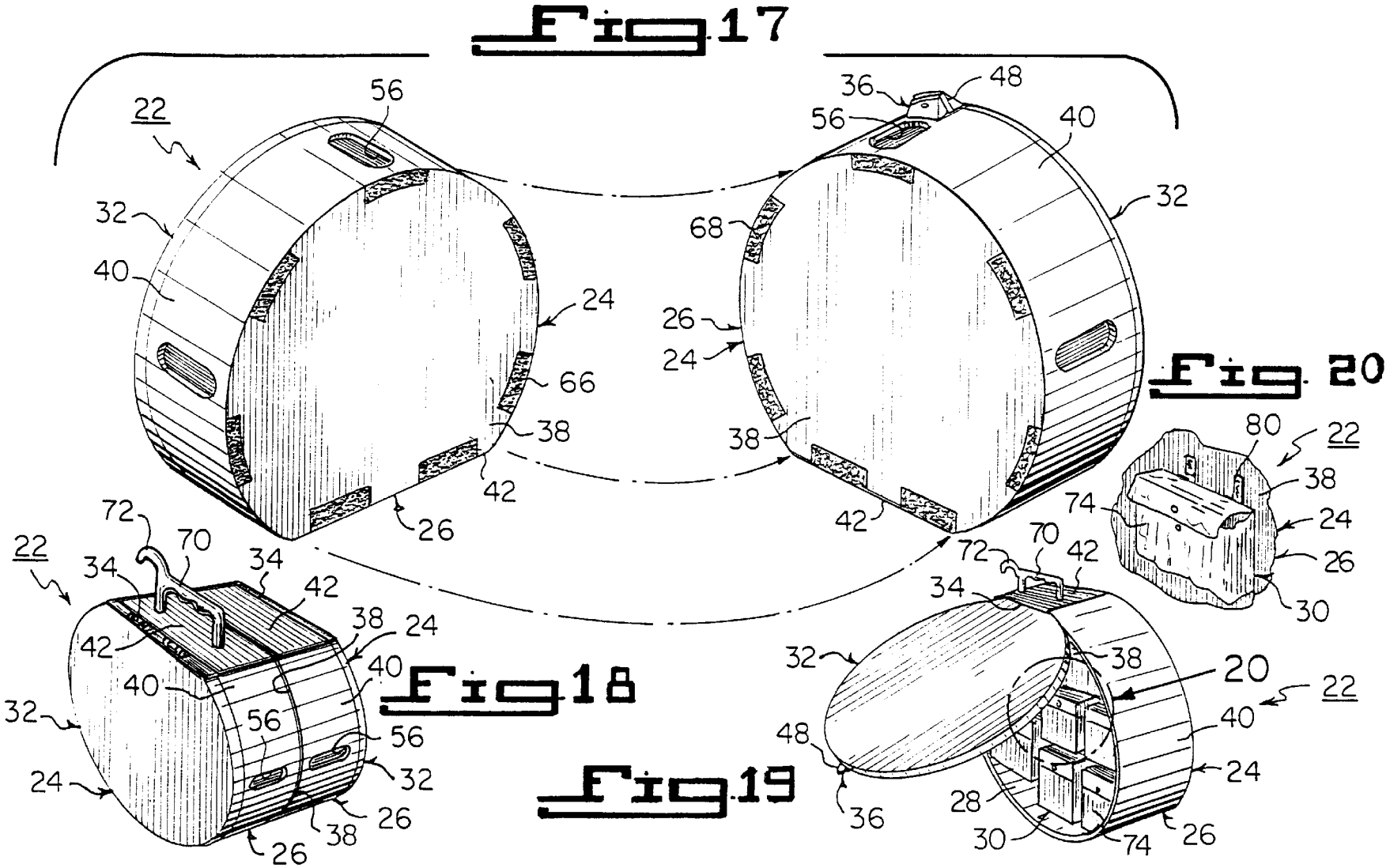

FIG. 17 is an exploded perspective view, showing two storage container ready to be removably connected together.

FIG. 18 is a perspective view of the two storage containers connected together and ready to be carried by a handle.

FIG. 19 is a perspective view of another type of storage container of the instant invention with the cover opened, showing a plurality of caddy pouches for holding various types of articles for the floor buffing/cleaning machine therein.

FIG. 20 is an enlarged perspective view of an area of FIG. 19 as indicated by arrow 20, showing one of the caddy pouches in greater detail.

Figure 21:
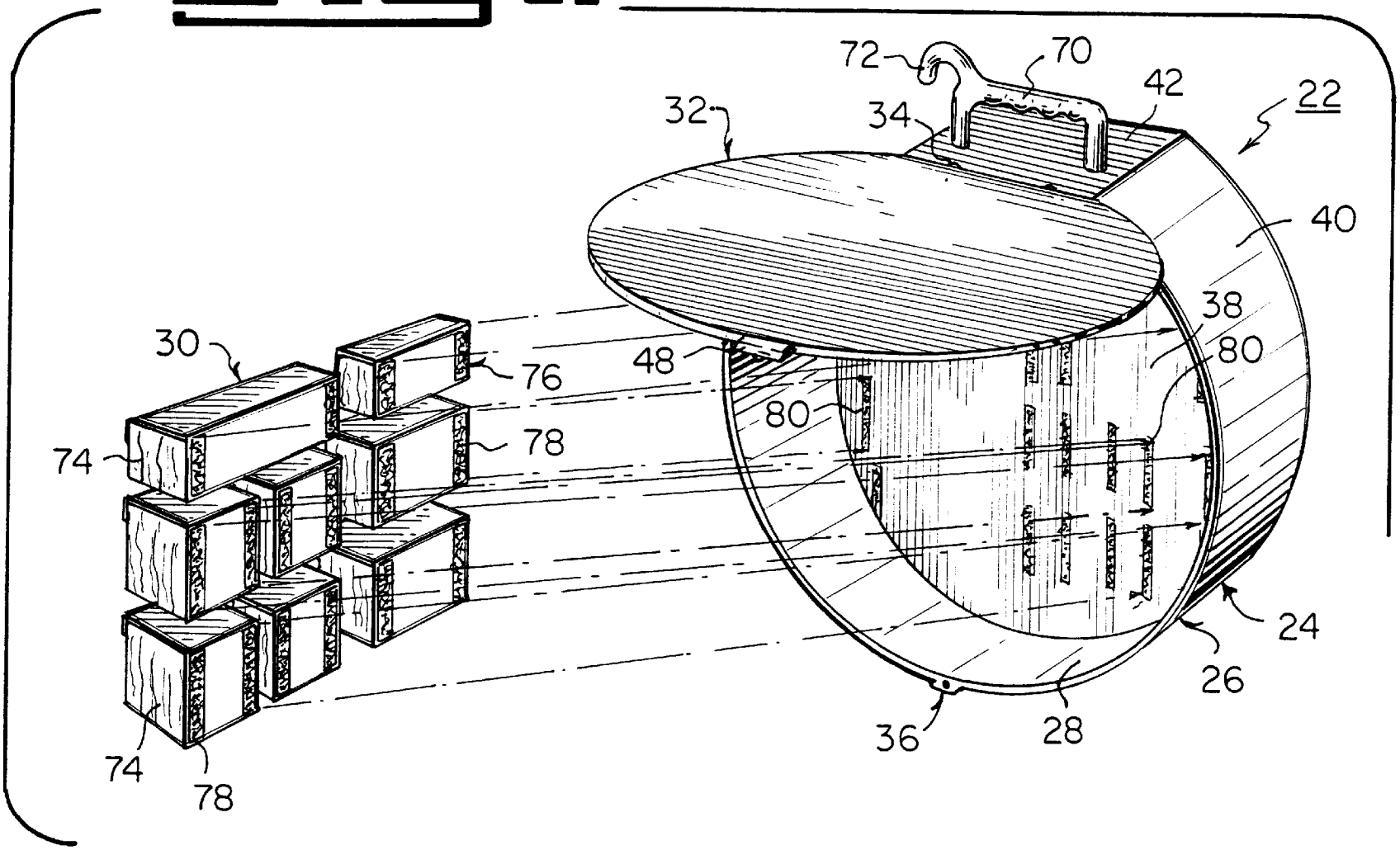

FIG. 21 is a perspective view similar to FIG. 19, showing all of the caddy pouches exploded from within the compartment of the base.

Similar reference characters denote corresponding features consistently throughout the attached drawings.

DESCRIPTION OF THE PREFERRED EMBODIMENTS

Turning now descriptively to the drawings, in which similar reference characters denote similar elements throughout the several views, FIGS. 1 through 21 illustrate a storage system 22 of the present invention. With regard to the reference numerals used, the following numbering is used throughout the various drawing figures.

22 storage saver system
24 storage container of 22
26 generally cylindrical shaped base of 24
28 compartment in 26
30 article
32 cover of 24
34 hinge between 26 and 32
36 retaining structure between 26 and 32
38 flat bottom wall of 26
40 curved side wall of 26
42 flat rear wall of 26
44 generally circular shaped dome of 32
46 flange about 44 of 32
48 latch mechanism for 36
50 radial rib web on 38
52 central spindle on 38
54 brush pad for 30
56 ventilation vent in 40
58 drip cup
60 housing of 58
62 open mouth of 60
64 retainer tab on 60 at 62
66 first VELCRO strip on 38
68 second VELCRO strip on another 38
70 pistol grip handle on 42
72 hook end on 70
74 caddy pouch for 30
76 securing facility of 30
78 first VELCRO strip on 74
80 second VELCRO strip on 38

The storage saver system 22 comprises a storage container 24 which includes a generally cylindrical shaped base 26, having a compartment 28 to hold at least one article 30 therein. A cover 32 extends over the compartment 28 of the base 26. A hinge 34 attaches the cover 32 to a top edge of the base 26. A structure 36 is for retaining the cover 32 in a closed position over the compartment 28, to keep the at least one article 30 within the compartment 28 of the base 26.

The base 26 consists of a flat bottom wall 38. A curved side wall 40 extends upwardly about the perimeter of the flat bottom wall 38. A flat rear wall 42 at the hinge 34 of the cover 32, extends upwardly from the flat bottom wall 38 adjacent the curved side wall 40, so as to form the compartment 28 for the base 26.

The cover 32 can include a generally circular shaped dome 44, having a flat edge at the hinge 34. A flange 46 can extend about the perimeter of the dome 44, whereby the flange 46 can sit upon a top edge of the base 26 in the closed position.

The retaining structure 36 is a latch mechanism 48 between the base 26 and the cover 32 opposite from the hinge 34. When the cover 32 goes into the closed position, the latch mechanism 48 will hold the cover 32 in the closed position. The flat bottom wall 38 of the base 26, as shown in FIG. 4, can include a radial rib web 50 for strengthening the flat bottom wall 38. The base 52, as shown in FIGS. 6 and 11, can contain a central spindle 52 extending upwardly from the flat bottom wall 38. The at least one article 30 being a brush pad 54 of a floor buffing/cleaning machine, can be placed within the compartment 28 over the central spindle 52.

The curved side wall 40 of the base 26 can have a plurality of spaced apart ventilation vents 56 thereabout, to allow any moisture in the brush pad 54 when placed within the compartment 28, to exit through the ventilation vents 56. A plurality of drip cups 58, can be provided as shown in FIGS. 11 to 16. Each drip cup 58 includes a housing 60 having an open mouth 62 shaped to fit over one ventilation vent 56. A pair of retainer tabs 64 are each located on opposite edges of the housing 60 at the open mouth 62. The retainer tabs 64 can snap into the ventilation vents 56, to allow the moisture to be trapped within the open mouth 62 of the housing 60.

FIG. 17 shows a plurality of VELCRO strips 66 attached about the perimeter of the flat bottom wall 38 of the base 26. A second storage container 24 with a plurality of mating VELCRO strips 68 attached about the perimeter of its flat bottom wall 38 of the base 26, can be removably connected to the first storage container 24 in a back-to-back relationship.

The storage saver system 22, as shown in FIGS. 18, 19 and 21, can further include a pistol grip handle 70 with a hook end 72, which can be connected to one of the flat rear walls 42 of one base 26, so that the two storage containers 24 can both be carried by the handle 70 to various locations. As shown in FIGS. 19, 20 and 21, at least one article 30 can be a plurality of caddy pouches 24, for holding various types of items for the floor buffing/cleaning machine. A facility 76 is for securing in a removable manner, the caddy pouches 74 to the flat bottom wall 38 within the compartment 28 of the base 26.

The securing facility 76 consists of a first set of VELCRO strips 78, attached to the rear surfaces of the caddy pouches 74. A second set of mating VELCRO strips 80 are attached to the inner surface of the flat bottom wall 38 of the base 26.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A storage saver system comprising a storage container which includes:

a) a generally cylindrical shaped base having a compartment to hold at least one article therein, said base including a flat bottom wall, a curved side wall extending upwardly about the perimeter of said flat bottom wall, a flat rear wall at said hinge of said cover, extending upwardly from said flat bottom wall adjacent said curved side wall, so as to form said compartment for said base, and a central spindle extending upwardly from said flat bottom wall, the at least one article being a brush pad of a floor buffing/cleaning machine can be placed within said compartment over said central spindle, wherein said curved side wall has a plurality of spaced apart ventilation vents thereabout, to allow any moisture in the brush pad when placed within said compartment to exit through said ventilation vents;

b) a cover to extend over said compartment of said base;

c) a hinge to attach said cover to a top edge of said base;

d) means for retaining said cover in a closed position over said compartment, to keep the at least one article within said compartment of said base and e) a plurality of drip cups, each drip cup including a housing having an open mouth shaped to fit over one said ventilation vent and a pair of retainer tabs, each located on opposite edges of said housing at said open mouth, so that said retainer tabs can snap into said ventilation vents to allow the moisture to be trapped within said open mouth of said housing.

2. A storage saver system as recited in claim 1, wherein said cover includes:

a) a generally circular shaped dome having a flat edge at said hinge; and b) a flange extending about the perimeter of said dome, whereby said flange can sit upon a top edge of said base in the closed position.

3. A storage saver system as recited in claim 1, wherein said retaining means is a latch mechanism between said base and said cover opposite from said hinge, so that when said cover goes into the closed position, said latch mechanism will hold said cover in the closed position.

4. A storage saver system as recited in claim 1, wherein said flat bottom wall of said base includes a radial rib web for strengthening said flat bottom wall.

5. A storage saver system as recited in claim 1, further including a plurality of hook and loop fastener strips attached about the perimeter of said flat bottom wall of said base, so that a second storage container with a plurality of mating hook and loop fastener strips attached about the perimeter of its said flat bottom wall of said base can be removably connected to said first storage container in a back-to-back relationship.

6. A storage saver system as recited in claim 5, further including a pistol grip handle with a hook end, said pistol grip handle being connected to one of said flat rear walls of one said base with said hook end protruding from said pistol grip handle, so that said two storage containers can both be carried by said handle to various locations.

7. A storage saver system as recited in claim 1, further including:

a) said at least one article being a plurality of caddy pouches for holding various types of items for a floor buffing/cleaning machine; and b) means for securing in a removable manner, said caddy pouches to said flat bottom wall within said compartment of said base.

8. A storage saver system as recited in claim 7, wherein said securing means includes:

a) a first set of hook and loop fastening strips attached to the rear surfaces of said caddy pouches; and b) a second set of mating hook and loop fastening strips attached to the inner surface of said flat bottom wall of said base.

9. A storage saver system as recited in claim 1, wherein said cover includes:

a) a generally circular shaped dome having a flat edge at said hinge; and b) a flange extending about the perimeter of said dome, whereby said flange can sit upon a top edge of said base in the closed position.

10. A storage saver system as recited in claim 9, wherein said retaining means is a latch mechanism between said base and said cover opposite from said hinge, so that when said cover goes into the closed position, said latch mechanism will hold said cover in the closed position.

11. A storage saver system as recited in claim 10, wherein said flat bottom wall of said base includes a radial rib web for strengthening said flat bottom wall.

12. A storage saver system as recited in claim 11, wherein said base further includes a central spindle extending upwardly from said flat bottom wall, the at least one article being a brush pad of a floor buffing/cleaning machine can be placed within said compartment over said central spindle.

13. A storage saver system as recited in claim 12, wherein said curved side wall of said base having a plurality of spaced apart ventilation vents thereabout, to allow any moisture in the brush pad when placed within said compartment to exit through said ventilation vents.

14. A storage saver system as recited in claim 13, further including a plurality of drip cups, in which each drip cup includes a housing having an open mouth shaped to fit over one said ventilation vent and a pair of retainer tabs, each located on opposite edges of said housing at said open mouth, so that said retainer tabs can snap into said ventilation vents to allow the moisture to be trapped within said open mouth of said housing.

15. A storage saver system as recited in claim 14, farther including a plurality of hook and loop fastener strips attached about the perimeter of said flat bottom wall of said base, so that a second storage container with a plurality of mating hook and loop fastener strips attached about the perimeter of its said flat bottom wall of said base can be removably connected to said first storage container in a back-to-back relationship.

16. A storage saver system as recited in claim 15, further including a pistol grip handle with a hook end which can be connected to one of said flat rear walls of one said base, so that said two storage containers can both be carried by said handle to various locations.

17. A storage saver system as recited in claim 16, further including:

a) said at least one article being a plurality of caddy pouches for holding various types of items for a floor buffing/cleaning machine; and b) means for securing in a removable manner, said caddy pouches to said flat bottom wall within said compartment of said base.

18. A storage saver system as recited in claim 17, wherein said securing means includes:

a) a first set of hook and loop fastening strips attached to the rear surfaces of said caddy pouches; and b) a second set of mating hook and loop fastening strips attached to the inner surface of said flat bottom wall of said base.

* * * * *